US007095016B2

(12) United States Patent
Oser et al.

(10) Patent No.: US 7,095,016 B2
(45) Date of Patent: Aug. 22, 2006

(54) DIRECT LIQUID INJECTION INLET TO A LASER PHOTOIONIZATION APPARATUS

(75) Inventors: Harald Oser, Menlo Park, CA (US); Michael J. Coggiola, Sunnyvale, CA (US); Steven E. Young, Mountain View, CA (US); David R. Crosley, Palo Alto, CA (US)

(73) Assignee: SRI International, Menlo Park, CA (US)

( * ) Notice: Subject to any disclaimer, the term of this patent is extended or adjusted under 35 U.S.C. 154(b) by 50 days.

(21) Appl. No.: 10/836,644

(22) Filed: Apr. 29, 2004

(65) Prior Publication Data

US 2004/0222373 A1 Nov. 11, 2004

Related U.S. Application Data

(60) Provisional application No. 60/467,162, filed on Apr. 29, 2003.

(51) Int. Cl.
*H01J 49/04* (2006.01)

(52) U.S. Cl. ..... 250/288; 250/289

(58) Field of Classification Search ..... 250/288, 250/289, 281, 282; 73/863.11, 863.12, 864.81
See application file for complete search history.

(56) References Cited

U.S. PATENT DOCUMENTS 4,358,302 A 11/1982 Dahneke ..... 55/392
5,285,064 A 2/1994 Willoughby ..... 250/288
5,917,185 A * 6/1999 Yeung et al. ..... 250/288
6,140,639 A * 10/2000 Gusev et al. ..... 250/288
6,534,765 B1 3/2003 Robb et al. ..... 250/288
6,646,257 B1 * 11/2003 Fischer et al. ..... 250/288
6,858,841 B1 * 2/2005 Truche et al. ..... 250/288
2004/0046126 A1 3/2004 Fisher

FOREIGN PATENT DOCUMENTS

EP 1193730 A1 4/2002

OTHER PUBLICATIONS

International Search Report and Written Opinion Of The International Searching Authority dated Feb. 3, 2005, for related PCT Application No. PCT/US2004/013821.

* cited by examiner

*Primary Examiner*—Kiet T. Nguyen
(74) *Attorney, Agent, or Firm*—Beyer Weaver & Thomas, LLP.

(57) ABSTRACT

A method and apparatus are provided for analyzing an analyte at low concentration in a liquid sample by photoionization and mass spectrometry. An inlet system is provided for direct injection of the liquid sample using a capillary tube. The method and apparatus allow for 20 to 2000-fold improvement of the lower detection limit of an analyte in a liquid sample compared to a conventional liquid chromatography/mass spectrometer apparatus.

14 Claims, 2 Drawing Sheets

DIRECT LIQUID INJECTION INLET TO A LASER PHOTOIONIZATION APPARATUS

CROSS-REFERENCE TO RELATED APPLICATION

This application claims priority under 35 U.S.C. §119(e) from U.S. Provisional Patent Application No. 60/467,162 filed on Apr. 29, 2003 by Oser, et al. and entitled, "DIRECT LIQUID INJECTION INLET TO A LASER PHOTOIONIZATION APPARATUS," which is incorporated by reference for all purposes.

STATEMENT REGARDING FEDERALLY SPONSORED RESEARCH

The invention was made with Government support under grant number N01-CM-87101 awarded by the Department of Health and Human Services, and the National Cancer Institute. The Government has certain fights in this invention.

This invention relates to a method and apparatus for providing improved detection of an analyte by photoionization in a vacuum laser/mass spectrometry chamber. The invention allows for direct injection of a liquid sample into such a chamber.

BACKGROUND OF THE INVENTION

Analytes in gases may be analyzed by vacuum laser photoinization and mass spectrometry. This technique is termed resonance enhanced multi-photonionization (REMPI) spectroscopy. Typically, a tunable dye laser (the pump laser) is scanned over the vibrational levels of the selected state while a second fixed wavelength laser (the probe laser) is used to induce ionization. When the pump laser is resonant, there is a great increase in ionization cross-section for a given photon flux, giving increased ion yield. The difference in ion yield between non-resonant and resonant absorption is used as a basis to record the REMPI spectrum. Once the sample is ionized, the ions are extracted to a mass spectrometer detector. By proper tuning the probe laser photoionizes the molecules of analytical interest. Analysis is performed by time-of-flight mass spectrometry with high efficiency and selectivity.

In particular, by using biological samples such as blood plasma, saliva and skin, it is feasible to detect biological analytes in such complex matrices at very low concentrations. However, detection limits using a typical REMPI system on biological analytes in such samples appear to about 0.2 to 1.0 μg/ml. Being that such biological samples are liquids, accuracy below this limit is compromised by absorption at the inlet system. Furthermore, absorption requires frequent cleaning of the system leading to slow turn around time. It would thus be desirable to avoid this problem and also to improve the inlet system such that liquid analytes may be analyzed to much lower limits of detection, such as those required for analyzing biological samples.

SUMMARY OF THE INVENTION

The present invention provides a method for analyzing an analyte at low concentration in a liquid sample by laser photoionization/mass spectrometry comprising the steps of (a) introducing a liquid sample containing the analyte into a capillary tube having a proximal end for receiving a liquid sample and a distal end for exit of the sample into a region of atmospheric or subatmospheric pressure; (b) forming the liquid sample exiting the distal end into a directed stream of droplets along a path toward a zone of photoionization under a gradient of successively lower pressure such that substantial condensation of the analyte along the path is avoided; (c) directing the stream into the zone of photoionization to ionize the analyte to form analyte ions; (d) passing the analyte ions into a mass analyzer of a mass spectrometer for analysis of the ions.

The preferred apparatus for performing this method comprises (a) a capillary tube for introducing a liquid sample into a region of atmospheric or subatmospheric pressure; (b) a zone of photoionization for irradiating evaporated droplets of the sample at subatmospheric pressure to ionize ionizable species; (c) a region characterized by a gradient of successively lower pressure along a path from the capillary tube to the zone of photoionization; (d) a collimator for directing a collimated stream of evaporated droplets of the sample along the path through the region of successively lower pressures toward the zone of photoionization such that condensation of the analyte along the path is substantially avoided and; (e) a mass spectrometer for determining the m/e ratio of ions formed by irradiating the sample.

The preferred system for analyzing the analyte is a photoionization/REMPI mass spectrometry system. A detectable limit for quantitative determination of an analyte in a liquid sample will be as low as about $10^{-4}$ μg/ml concentration of analyte in the sample.

The evaporated droplets of the liquid sample are preferably directed into the zone of photoionization at an average chamber pressure of $10^{-5}$ to $10^{-4}$ torr. Upon exit from the collimator, the distance from the collimator to the zone of irradiation is preferably in the range of about 12 to about 0.5 cm.

Photoionization is preferably performed by a laser, typically a tunable laser. The term "capillary tube" includes, but is not limited to, a nanotube, a small gas chromatography column, and a liquid chromatograph capillary inlet.

If using a photoionization/mass spectrometry system, due to the close proximity of the droplet stream to the zone of irradiation, there may not be enough cooling of the sample to allow a signature spectrum to be taken. However, there are at least two alternative ways to identify the presence of the analyte. Firstly, one may inject a sample having a higher concentration of analyte and use a supersonic jet-cooled inlet to measure a jet-cooled spectrum to determine of anything else appears at the same atomic mass in the sample. If no interferences are found, then the sample may be injected using the mass as a sole identification criterion.

Alternatively, one may separate the sample using liquid chromatographic separation. Following this by photoionization/REMPI detection instead of conventional mass spectroscopy or fluorescent detection increases sensitivity.

DETAILED DESCRIPTION OF THE PREFERRED EMBODIMENTS

Figure 1:
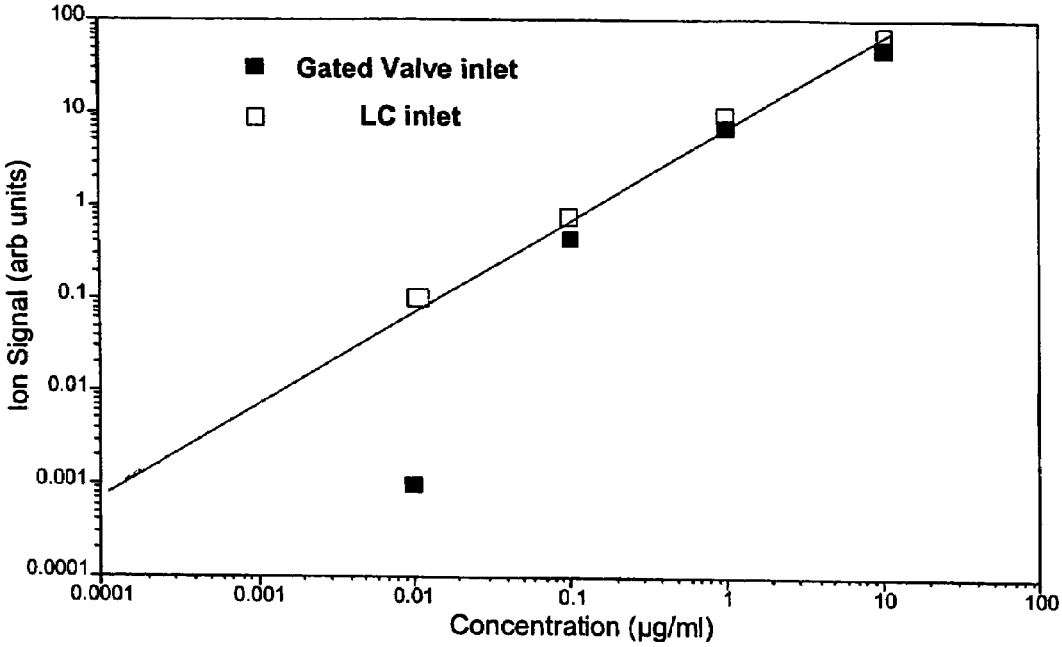
FIG. 1 is a graph of the signal response versus known concentration of an analyte using the method of the present invention.

Referring to FIG. 1, there is shown a graph of signal response versus known concentration of the cancer drug XK469 in a liquid sample. The solid line indicates the known concentration of XK469 in an injected sample. The dark squares indicate the concentration observed using the jet-REMPI system unmodified. As can be seen, the unmodified system is relatively accurate to a detectable concentration of about 0.1 μg/ml of sample. However, at a concentration of 0.01 μg/ml, the unmodified system is grossly inaccurate. The light squares indicate the data obtained using the modified capillary inlet tube inlet according to the present invention. The data indicates a linear relationship from high concentrations to the lowest concentration tested at 0.01 μg/ml. These results show that there is no loss of XK469 using the capillary inlet as opposed to a 60 fold loss using the unmodified jet inlet. Furthermore, because the analyte does not condense en route to the photoionization zone, it does not clog the inlet, requires less cleaning and results in more efficient use of the instrument in terms of samples that may be run over given period of time.

Figure 2:
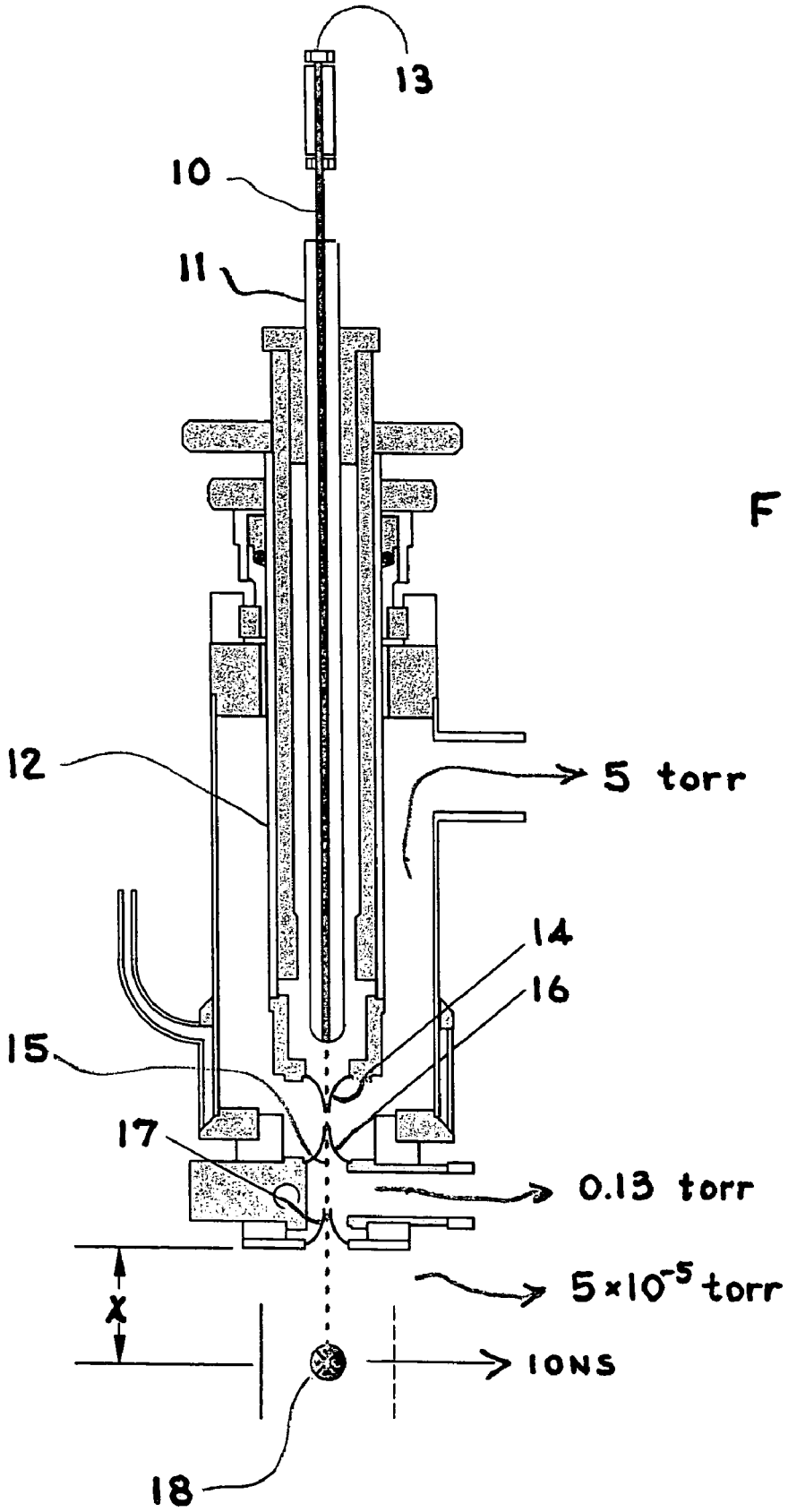
FIG. 2 is a schematic drawing of a preferred inlet according to the present invention.

Referring to FIG. 2 there is shown an inlet apparatus according to the present invention for direct liquid injection into a laser photoionization/mass spectrometer system. The liquid chromatographic inlet comprises a long tube 10, which is coaxially disposed with a casing 11 into the injection inlet of the photoionization apparatus. As shown, the injection inlet is part of a photoionization/REMPI apparatus, but the invention is not limited thereto. The sample is injected at inlet 13 and exits the other end of tube 10 to pass through nozzle 14. The typical nozzle diameter is about 0.1 to 0.8 millimeters, and a useful diameter is about 0.4 millimeters. The liquid sample after passing through the nozzle is in droplet form. The droplets 15 pass through successively decreasing zones of pressure. The first zone is under atmospheric or subatmospheric pressure. Preferably, subatmospheric pressure is used, typically of about 1 to 10 torr. The pressure of 5 torr is shown in the figure. The droplets 15 then pass through a skimmer 16 of slightly larger diameter, typically about 0.4 to 0.8 mm. A useful skimmer diameter is about 0.6 mm. The droplets then pass through a lower pressure zone, typically at a pressure of about 0.1 to 1 torr. A useful pressure of 0.13 torr as shown in the figure. Finally, the droplets pass through a collimator 17, typically having a diameter of about 0.8 to 1.2 millimeter. As shown in the figure, the collimator has a diameter of about 1 millimeter. After passing through the collimator, the column of evaporated droplets is subjected to yet a further reduction in pressure, typically to about $10^{-4}$ to $10^{-5}$ torr. As shown that pressure is $5\times10^{-5}$ torr.

The collimated evaporated droplets are then passed into the laser beam 18 where the analyte species in the sample is ionized. The ions are extracted and directed to a mass spectrometer (not shown) for analysis. The distance x between the exit of the collimator 17 and the laser beam 18 may be varied to adjust the sensitivity of the analysis. Typically the distance x will be in the range of about 12 to 0.5 centimeters.

The following example is provided for the purposes of illustration and is not intended to limit the scope of the invention.

EXAMPLE

Utilizing a modified photoionization/REMPI system as shown in FIG. 2, liquid samples containing the cancer drug XK469 were injected into the inlet. The laser was adjusted to for excitation wavelength of 266 nm. This wavelength is readily available from solid state Nd—YAG lasers, which are commercially available. The distance x used was 12.5 centimeters. Liquid samples containing known quantifies of XK469 were injected using a conventional unmodified jet-REMPI inlet system and a modified inlet system according to the invention. The results are shown in FIG. 1. In this configuration, the accurate lower limit of detection of XK469 according to the invention is about 0.01 μg/ml as compared to the lowest limit of detection of about 0.2 μg/ml using a conventional liquid chromatography/mass spectrometer apparatus. This is about a 20× improvement in detectability. By moving the evaporated droplet inlet closer to the laser beam, the lower detection limit according to the invention may be on the order of about $10^{-4}$ μg/ml, or an improvement of 2000× over the current detection limit of a conventional liquid chromatography/mass spectrometer apparatus. Since direct liquid injection did not cool the sample sufficiently, to identify the analyte, mass identification may be used. This may be performed by using an unmodified jet cooled system to determine the spectra of the sample at higher concentration to determine if there is any other material appearing at the same atomic mass in the actual sample, for example, of human tissue or plasma. In this instance, one would check for interferences at the appropriate absorption wavelength of the same mass, 160 amu for compound XK469. If no interferences in the sample are found, one could proceed with the direct liquid injection inlet using mass as the sole mode of identification.

The present invention of this application is not only in pharmacokinetics, but also in other fields as well, including, but not limited to medical/health applications.

What is claimed is:

1. A method for analyzing an analyte at low concentration in a liquid sample by mass spectrometry comprising the steps of:

(a) introducing a liquid sample containing said analyte into a capillary tube having a proximal end for receiving a liquid sample and a distal end for exit of said sample;

(b) forming the liquid sample exiting said distal end into a directed stream of droplets along a path toward a zone of photoionization under a gradient of successively lower pressure such that substantial condensation of said analyte along said path is avoided;

(c) directing said stream into said zone of photoionization to ionize said analyte to form analyte ions; and (d) passing said analyte ions into a mass analyzer of a mass spectrometer for mass analysis of said ions.

2. A method according to claim 1 wherein in said step (a) said sample exits into a region under atmospheric pressure.

3. A method according to claim 1 wherein in said step (a) said sample exits into a region under under subatmospheric pressure.

4. A method according to claim 1 wherein said analyte is quantitatively analyzed.

5. A method according to claim 1 wherein in said step (c) said stream is directed into said zone of photoionization at a pressure in the range of $10^{-4}$ to $10^{-5}$ torr.

6. A method according to claim 1 wherein said stream is passed along said path through a collimator directly into said zone of photoionization.

7. A method according to claim 6 wherein the distance from said collimator to said zone of photoionization is in the range of about 12 to about 0.5 centimeters.

8. A method according to claim 7 wherein said distance and the pressure at which said stream is introduced into said zone of photoionization are selected so that the analyte is detectable at a minimal concentration in a sample of about 0.0001 μg/ml.

9. A method according to claim 1 wherein said zone of photoionization is provided by a laser.

10. An apparatus for irradiation of a liquid sample containing an analyte to be ionized, comprising:

(a) a capillary tube for introducing said liquid sample as droplets into said apparatus;

(b) a zone of photoionization for irradiating evaporated droplets of said liquid sample at subatmospheric pressure to form ionizable species;

(c) a region of subatmospheric pressure characterized by a gradient of successively lower pressure along a path toward said zone of photoionization;

(d) a collimator for directing a collimated stream of evaporated droplets of said sample along said path directly into said zone of photoionization; and (e) a mass spectrometer for determining the m/e ratio of ions found by irradiating said sample.

11. An apparatus according to claim 10 wherein said capillary tube is located to introduce said droplets into a region under atmospheric pressure in said apparatus.

12. An apparatus according to claim 10 wherein said capillary tube is located to introduce said droplets into a region under subatmospheric pressure in said apparatus.

13. An apparatus according to claim 10 wherein the distance from said collimator to said zone of photoionization is in a range of about 12 centimeters to about 0.5 centimeters.

14. An apparatus according to claim 10 wherein said zone of photoionization is provided by a laser.

* * * * *